US011510476B2

(12) United States Patent
Silva et al.

(10) Patent No.: US 11,510,476 B2
(45) Date of Patent: Nov. 29, 2022

(54) CONTAINER AND DISPENSER SYSTEM AND APPARATUS

(71) Applicant: Rea.deeming Beauty, Inc., Bethlehem, PA (US)

(72) Inventors: Rea Ann Silva, Bethlehem, PA (US); Brittany Blass, Venice, CA (US); Barnabas Kegye, Brooklyn, NY (US)

(73) Assignee: REA.DEEMING BEAUTY, INC., Bethlehem, PA (US)

( * ) Notice: Subject to any disclaimer, the term of this patent is extended or adjusted under 35 U.S.C. 154(b) by 0 days.

(21) Appl. No.: 17/231,709

(22) Filed: Apr. 15, 2021

(65) Prior Publication Data

US 2021/0227951 A1 Jul. 29, 2021

Related U.S. Application Data

(63) Continuation of application No. 16/369,839, filed on Mar. 29, 2019, now Pat. No. 11,006,724.

(60) Provisional application No. 62/650,532, filed on Mar. 30, 2018.

(51) Int. Cl.

| | |
|---|---|
| ***A45D 34/04*** | (2006.01) |
| ***A45D 34/00*** | (2006.01) |
| ***B05C 17/005*** | (2006.01) |
| ***B65D 83/00*** | (2006.01) |

(52) U.S. Cl.

CPC ..... *A45D 34/04* (2013.01); *B65D 83/0005* (2013.01); *A45D 2034/007* (2013.01); *A45D 2200/055* (2013.01); *B05C 17/005* (2013.01)

(58) Field of Classification Search

CPC ..... A45D 34/04; A45D 2200/055; A45D 2034/007; A45D 2200/056; A45D 2200/057; B65D 35/36; B65D 35/38; B65D 88/54; B05C 17/00569; B05C 17/005; B05C 17/01; B05C 17/03; B05C 17/0333; B05C 17/0341

USPC ..... 401/123, 125, 188 R

See application file for complete search history.

(56) References Cited

U.S. PATENT DOCUMENTS

| | | | | |
|---|---|---|---|---|
| 3,906,814 | A * | 9/1975 | Magnussen | H01H 9/20 400/663 |
| 6,158,674 | A | 12/2000 | Humphreys | |
| 6,736,562 | B2 | 5/2004 | Whitmore | |
| 7,579,563 | B2 * | 8/2009 | Inagaki | H01H 9/06 200/332.2 |
| 7,963,425 | B2 | 6/2011 | White et al. | |
| 8,267,610 | B2 | 9/2012 | Goodman | |
| 2010/0275948 | A1 | 11/2010 | Parker | |
| 2014/0001210 | A1 | 1/2014 | Lim | |

(Continued)

*Primary Examiner* — David J Walczak

(74) *Attorney, Agent, or Firm* — Concept IP LLP; Pejman Yedidsion

(57) ABSTRACT

An apparatus and system including: a top cap comprising a press button; a pump actuator partially disposed in the top cap, where a depression of the press button actuates the pump actuator; a front plate comprising a nozzle opening disposed proximate a first end of the front plate, where the front plate is attached to the top cap; a front nozzle attached to the pump actuator and disposed through the nozzle opening in the front plate; an indentation on a top surface of the front plate, where the front nozzle is angled to disperse a liquid onto the indentation; and a bottle attached to the pump actuator, wherein the bottle is configured to contain the liquid.

16 Claims, 12 Drawing Sheets

(56) References Cited

U.S. PATENT DOCUMENTS

| | | | |
|---|---|---|---|
| 2016/0242529 | A1 | 8/2016 | Oh et al. |
| 2017/0143102 | A1 | 5/2017 | Silva |

* cited by examiner

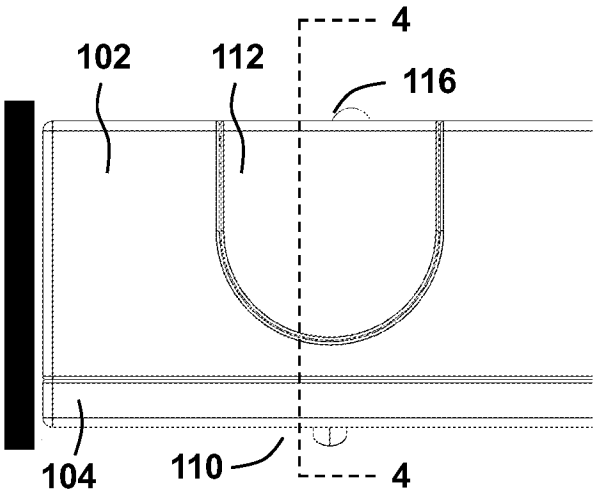
FIG. 1E
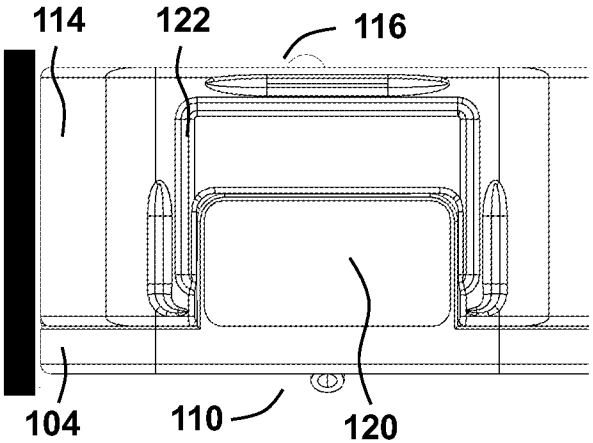
FIG. 1F
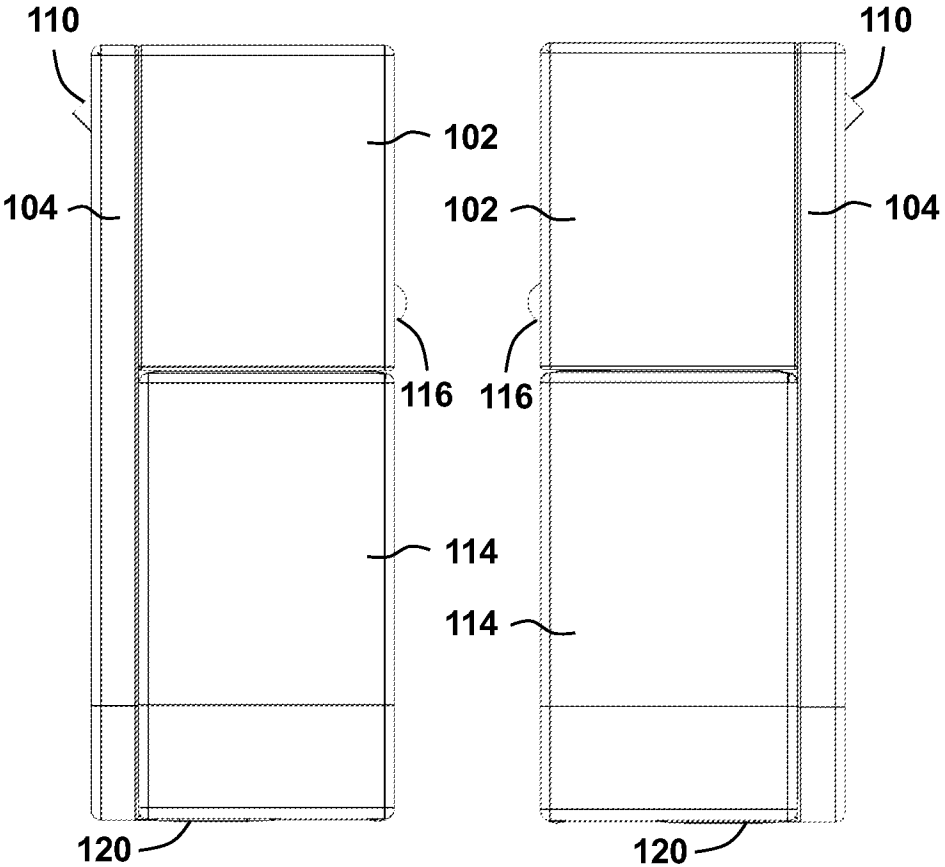
FIG. 1G
FIG. 1H

CONTAINER AND DISPENSER SYSTEM AND APPARATUS

CROSS-REFERENCE TO RELATED APPLICATIONS

This application is a continuation of U.S. Non-Provisional patent application Ser. No. 16/369,839 filed Mar. 29, 2019, which issued as U.S. Pat. No. 11,006,724 on May 18, 2021, which claims priority to U.S. Provisional Pat. App. No. 62/650,532 filed Mar. 30, 2018, the contents of all of which are hereby incorporated by reference herein for all purposes.

FIELD OF ENDEAVOR

The invention, in its several embodiments, pertains to liquid foundation, and more particularly to a liquid foundation container and dispenser.

BACKGROUND

Users may apply makeup, specifically, liquid foundation directly onto the back of their hand from the container where the back of the hand is used as a palette. This may make it difficult to ascertain the amount remaining and/or color of the liquid foundation for application to a user's skin, e.g., face. If the makeup or liquid foundation is not completely removed, it may blend into the skin on the back of the user's hand, and may be transferred and/or smeared onto the user's clothes or personal articles or items.

SUMMARY

Some aspects of the present embodiments may include a system including: a top cap comprising a press button; a pump actuator partially disposed in the top cap, where a depression of the press button actuates the pump actuator; a front plate comprising a nozzle opening disposed proximate a first end of the front plate, where the front plate is attached to the top cap; a front nozzle attached to the pump actuator and disposed through the nozzle opening in the front plate; an indentation on a top surface of the front plate, where the front nozzle is angled to disperse a liquid onto the indentation; and a bottle attached to the pump actuator, where the bottle is configured to contain the liquid.

Additional system embodiments may include: a button opening disposed in the top cap. Additional system embodiments may include: at least one protrusion disposed on the pump actuator; a back button plate comprising at least one protrusion; and a back button attached to the back button plate and disposed through the button opening, where the back button may be slidable in the button opening between a locked position and an unlocked position; and where the at least one protrusion of the back button plate may contact the at least one protrusion of the pump actuator to prevent the depression of the press button in the locked position. Additional system embodiments may include: a platform disposed distal from the nozzle opening.

Additional system embodiments may include: a bottom surface of the bottle secured by the platform. Additional system embodiments may include: at least one protrusion disposed on the platform. Additional system embodiments may include: at least one indentation disposed on a bottom surface of the bottle, where the at least one protrusion of the platform fits into the at least one indentation of the bottle to secure the bottle against the platform. In additional system embodiments the system is in at least one of: a substantially vertical position, a substantially horizontal position, and a 45-degree angle during the depression of the front button, where the system may be rotated to a horizontal position once the liquid is dispersed onto the indentation, where in the vertical position the front plate may be substantially perpendicular to a local plane, and where in the horizontal position the front plate may be substantially parallel to the local plane.

In additional system embodiments, the indentation may be proximate the nozzle opening of the front plate. In additional system embodiments, the indentation may be a teardrop shape. In additional system embodiments, the bottle may be disposed proximate the front plate in an installed position. In additional system embodiments, the indentation may provide varying amounts of liquid across a surface area of the indentation. Additional system embodiments may include: a makeup tool, where the makeup tool is configured to pick up the varying amounts of liquid from the indentation. In additional system embodiments, the liquid may be a liquid foundation. In additional system embodiments, the bottle may be detachably attached to the pump actuator.

A method may include: moving a back button of a foundation pump to an unlocked position, where the unlocked position allows for a depression of a press button; depressing the press button to actuate a pump actuator; and dispensing a liquid onto a front plate via a nozzle, where the nozzle may be connected to a first end of the pump actuator, and where a bottle containing the liquid may be connected to a second end of the pump actuator. Additional method embodiments may include: dispersing the dispensed liquid via an indentation on the front plate. Additional method embodiments may include: applying a selective amount of the dispersed liquid via a makeup tool. Additional method embodiments may include: moving the back button of the foundation pump to a locked position, where the locked position prevents depression of the press button.

A foundation pump embodiment may include: a top cap comprising a press button; a pump actuator partially disposed in the top cap, where a depression of the press button actuates the pump actuator; a front plate comprising a nozzle opening disposed proximate a first end of the front plate, where the front plate may be attached to the top cap; a front nozzle attached to the pump actuator and disposed through the nozzle opening in the front plate; an indentation on a top surface of the front plate, where the front nozzle may be angled to disperse a liquid onto the indentation; a platform disposed distal from the nozzle opening; at least one protrusion disposed on the platform; a bottle detachably attached to the pump actuator, where the bottle may be configured to contain the liquid, and where the bottle is disposed proximate the front plate in an installed position; at least one indentation disposed on a bottom surface of the bottle, where the at least one protrusion of the platform fits into the at least one indentation of the bottle to secure the bottle against the platform; a button opening disposed in the top cap; at least one protrusion disposed on the pump actuator; a back button plate comprising at least one protrusion; and a back button attached to the back button plate and disposed through the button opening, where the back button may be slidable in the button opening between a locked position and an unlocked position, where the at least one protrusion of the back button plate may contact the at least one protrusion of the pump actuator to prevent the depression of the press button in the locked position.

BRIEF DESCRIPTION OF DRAWINGS

The components in the figures are not necessarily to scale, emphasis instead being placed upon illustrating the principals of the invention. Like reference numerals designate corresponding parts throughout the different views. Embodiments are illustrated by way of example and not limitation in the figures of the accompanying drawings, in which:

FIG. 1E depicts a top view of the foundation pump embodiment of FIG. 1A;

FIG. 1F depicts a bottom view of the foundation pump embodiment of FIG. 1A;

FIG. 1G depicts a right side view of the foundation pump embodiment of FIG. 1A;

FIG. 1H depicts a left side view of the foundation pump embodiment of FIG. 1A;

DETAILED DESCRIPTION

Figure 1B:
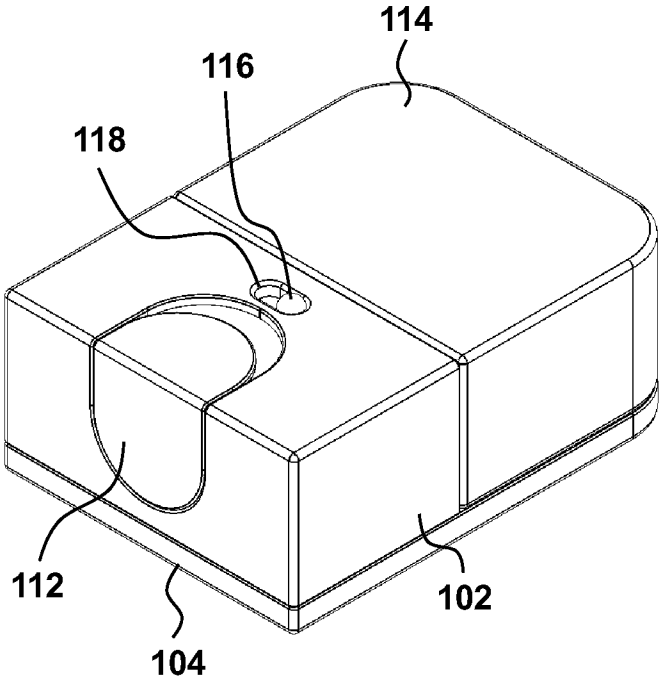
FIG. 1B depicts a reverse perspective view of the foundation pump embodiment of FIG. 1A.

The disclosed container and dispenser system and apparatus allow for storing and dispensing liquid foundation, or other cosmetic/makeup, onto an indentation or well on a front plate of the apparatus. In some embodiments, the container and dispenser system and apparatus may be in the form of an automatic machine or container designed to release a specific amount of liquid, thereby the system provides a method of applying a makeup applicator to the liquid foundation. That is, the liquid foundation may be mixed and/or dispersed to allow for easier control and use of the liquid foundation with a sponge or other makeup tool or applicators. Using the front plate of the apparatus to mix and apply the foundation, the apparatus allows the user to keep the back of their hand free from makeup which may otherwise rub off on their clothes or accessories and reduces the need for additional makeup tools such as an additional surface for mixing or applying makeup. The front plate may be cleaned after use thereby allowing the foundation pump apparatus to be easily transported in a bag. A locking button may prevent unintended dispensing of the liquid foundation. The disclosed aspects of the different embodiments provide an all-in-one system where the container and dispenser apparatus also provide a reservoir—via the indentation or well—to apply the dispensed liquid cosmetic.

Liquid cosmetic, such as foundation is a makeup that may be applied to the skin, e.g., face or neck, to create a uniform appearance and/or color via a tool, such as a sponge, brush, finger, or other makeup tool. In one embodiment, the disclosed indentation or well provides an area to dispense the liquid cosmetic, e.g., foundation, and hold and/or maintain the liquid (which may be thick or dense liquid) in place and ready to be applied. In some embodiments, the apparatus may be positioned at an angle which is not perpendicular to a local plane—the local plane being parallel to the surface of the earth—so as to allow the liquid to be held in place. In one example, the apparatus may be at a 45-degree angle from the local plane when used to dispense foundation into the reservoir to create a surface for managing the liquid. The different aspects of the present embodiments provide a relationship or association between the depth of the indentation or well and the angle of placement necessary for the liquid to be sustained and/or held on the surface of the indentation or well without succumbing to the gravitation pull from the earth. That is, the deeper the depth of the indentation or well, the more upright the apparatus may be held so that the liquid does not begin to slide down to the local plane. In additional embodiments, different materials which may not have a smooth surface or sliding/slippery characteristics—but not absorbent—may be used to help hold and/or maintain the liquid in place, even at an angle of positioning the apparatus that is more perpendicular to the local plane. In an alternative embodiment, the liquid foundation may be dispensed directly onto a makeup applicator or skin.

In one embodiment, the user may pump one or more liquid foundations onto the indentation or well on the front plate. The user may pump the foundation onto the front plate by depressing a button while the apparatus is in a substantially vertical orientation, such as where the front plate of the apparatus is substantially perpendicular to the local plane.

The user may also pump the foundation onto the front plate while the apparatus is in a substantially horizontal orientation, such as where the front plate of the apparatus is substantially parallel to the local plane, or while the apparatus is at an angle, e.g., between 0 and 90, such as a 45-degree angle with respect to the local plane. The user may then rotate the pump to a substantially horizontal orientation, such as where the front plate of the apparatus is substantially parallel to the local plane. The user could set the apparatus down on a surface, such as a bathroom counter, in the horizontal position to pick up a selective amount of the foundation via the makeup tool. The user may also vary the angle of the apparatus, such as when held in the hand of the user, to utilize the front plate as an artist would use an easel.

The indentation or well may provide space that allows the user to control the amount of foundation applied to the makeup tool and from the makeup tool to the face. The makeup tool may be used to spread out the foundation across the surface of the front plate and indentation. The makeup tool may be used to pick up a selective amount of foundation just as an artist may use a brush to pick up a selective amount of paint on an easel. A contrasting color to the foundation, such as a silver color, on the front plate may make it easier for a user to see how much foundation is present on the surface of the front plate.

By contrast, applying foundation directly to the back of the user's hand may make it difficult for the user to determine the amount of foundation present or remaining. Further, applying foundation to the back of the user's hand may also result in inadvertent transfer of the foundation to another part of the user, their accessories, and/or their clothing. As foundation may blend into the skin tone of a user, it may be difficult to determine whether foundation has been removed once the user is finished applying their makeup.

The indentation may also be used to mix the foundation with other makeup. The user may combine the dispensed foundation with another color of foundation to create a desired color. The user may also mix a modifiable primer, an oil, or a texturizer in with the foundation in the indentation. The user may then pick up a selective amount of this mixture via the makeup tool and apply the mixture to, for example, the face. The user may desire different colors of foundation at different stages of the makeup application process. The user may adjust the foundation color in the indentation during the makeup application process, which gives the user far greater control than attempting to mix colors on the back of the user's hand. In some embodiments, the other makeup may also be stored and dispensed via the apparatus. In other embodiments, the other makeup may be placed on the front plate of the apparatus from an external source, such as another makeup container.

Figure 1A:
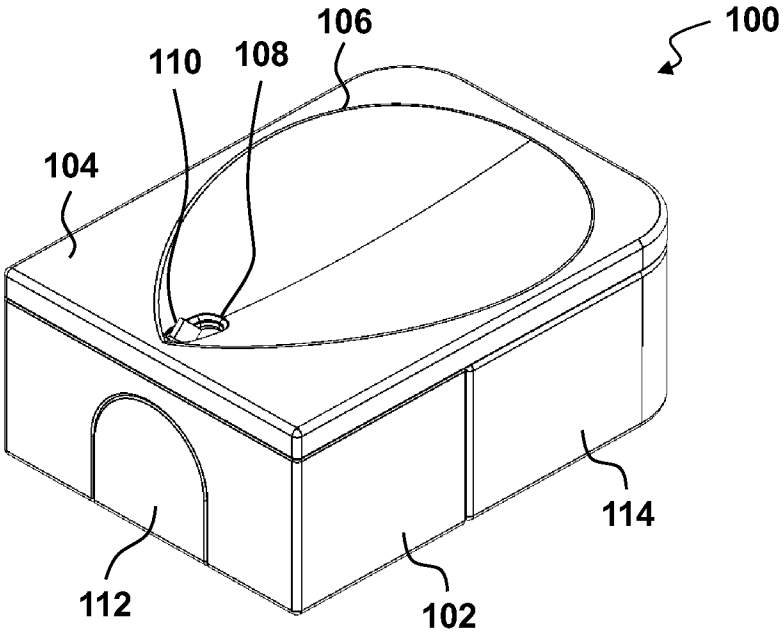
FIG. 1A depicts a perspective view of a foundation pump embodiment.
Figure 1D:
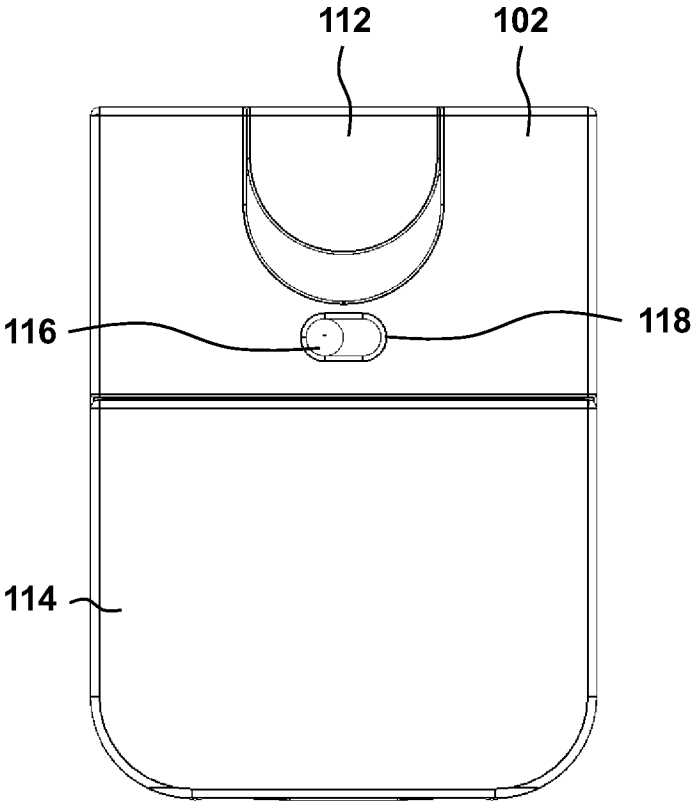
FIG. 1D depicts a rear view of the foundation pump embodiment of FIG. 1A.
Figure 1C:
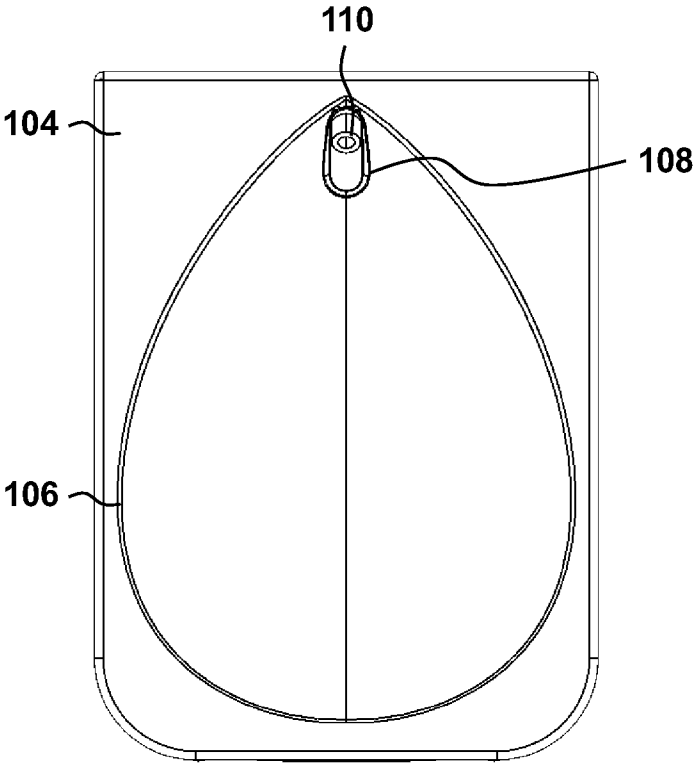
FIG. 1C depicts a front view of the foundation pump embodiment of FIG. 1A.

FIG. 1A depicts a perspective view of a foundation pump apparatus 100. FIG. 1B depicts a reverse perspective view of the foundation pump embodiment of FIG. 1A. FIG. 1C depicts a front view of the foundation pump embodiment of FIG. 1A. FIG. 1D depicts a rear view of the foundation pump embodiment of FIG. 1A. FIG. 1E depicts a top view of the foundation pump embodiment of FIG. 1A. FIG. 1F depicts a bottom view of the foundation pump embodiment of FIG. 1A. FIG. 1G depicts a right side view of the foundation pump embodiment of FIG. 1A. FIG. 1H depicts a left side view of the foundation pump embodiment of FIG. 1A.

The foundation pump 100 may include a top cap 102 connected to a front plate 104. The top cap 102 and front plate 104 may be detachably attached, such as by a snap fit, or fixedly attached, such as by an adhesive. In some embodiments, the top cap 102 and front plate 104 may be a single part. The top cap 102 and front plate 104 may be made from plastic, metal, or any other suitable material. In some embodiments, the top cap 102 and front plate 104 may have a matte aluminum appearance.

The front plate 104 may include an indentation 106. In one embodiment, the indentation 106 may have a generally teardrop shape. In one embodiment, the shape of a sponge or other makeup tool used to pick up a liquid foundation, or other makeup, from the indentation 106 may match the shape of the indentation 106. In other embodiments, the indentation 106 may be another shape such as a circle, oval, rounded rectangle, or any other suitable shape. The indentation 106 provides a surface or well for receiving and/or mixing liquid foundation, or other makeup products.

In some embodiments, the front plate 104 may include a nozzle opening 108 disposed proximate a first end of the front plate 104. A front nozzle 110 may be disposed proximate and/or through the nozzle opening 108 in the front plate 104. The front nozzle 110 may dispense liquid foundation, or other makeup products, into the indentation 106 on the front plate 104. The varied geometry of the indentation 106 allows a user to pick up a desired amount of liquid foundation via a sponge or other makeup application tool, such as a brush, finger, or other makeup tool. In some embodiments, the nozzle 110 may be angled down toward the top surface of the front plate 104 to avoid dispensing liquid outside of the front plate 104. In other embodiments, the nozzle 110 may be retracted when not in use.

A press button 112 may be disposed in the top cap 102. Depressing the press button 112 when not in a locked position may allow a liquid foundation to be pumped from a container or bottle 114 through a pump actuator and the nozzle 110 to the indentation 106 on the front plate 104. The bottle 114 may be detachably attached to the pump actuator. The bottle 114 may be disposed proximate the front plate in an installed position. In one embodiment, the bottle 114 may be made from glass or plastic. In some embodiments, the bottle 114 may have a frosted clear appearance. In another embodiment, the bottle 114 may comprise a container for holding and/or storing a single liquid. In some embodiments, the bottle 114 may comprise two or more containers for holding and/or storing two or more liquids in separate containers in the bottle 114, such as liquid foundation or other makeup.

The front plate 104 may also include a platform 120 disposed distal from the nozzle opening 108. The platform 120 may include at least one protrusion. The bottle 114 may include at least one indentation 122 disposed on a bottom surface. The at least one protrusion of the platform 120 may fit into the at least one indentation 122 of the bottle 114 to secure the bottle 114 against the platform 120, the front plate 104, and/or the top portion 102.

A back button 116 may be attached to a back button plate having at least one protrusion. The at least one protrusion may be a button having rounded edges. The back button 116 may be disposed through a button opening 118 in the top cap 102. The button opening 118 may be a channel, such as a channel having rounded edges. The back button 116 may be slidable in the button opening 118 between a locked position and an unlocked position. The locked position may prevent the depression of the press button 112 while in the locked position to prevent accidental dispensing of liquid foundation, or other makeup.

In some embodiments, the back button 116 and button opening 118 may provide for a variable dispensing rate of liquid disposed in the bottle 114. For example, a far left position of the button 116 in the button opening 118 may allow for minimal or no dispensing; as the button 116 slides and moves toward the opposite side, e.g., right side of the button opening 118 the amount of liquid dispensed may increase; and a far right position of the button 116 in the button opening 118 may allow for a maximum dispensing of the liquid. In other embodiments, there may be one or more dispensing levels, such as a minimal dispensing, a moderate dispensing, and a greatest dispensing. Varying the dispensing level of the liquid may allow a user to dispense the liquid in desired amounts such as smaller quantities. In other embodiments, the amount of liquid dispensed may be varied by the speed and/or force used to depress the button 112.

Figure 2B:
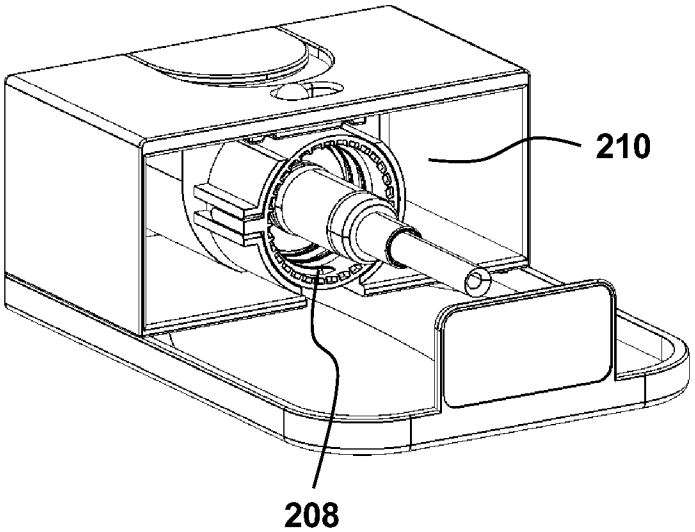
FIG. 2B depicts a reverse perspective view of the foundation pump embodiment of FIG. 2A with the bottle removed.
Figure 2A:
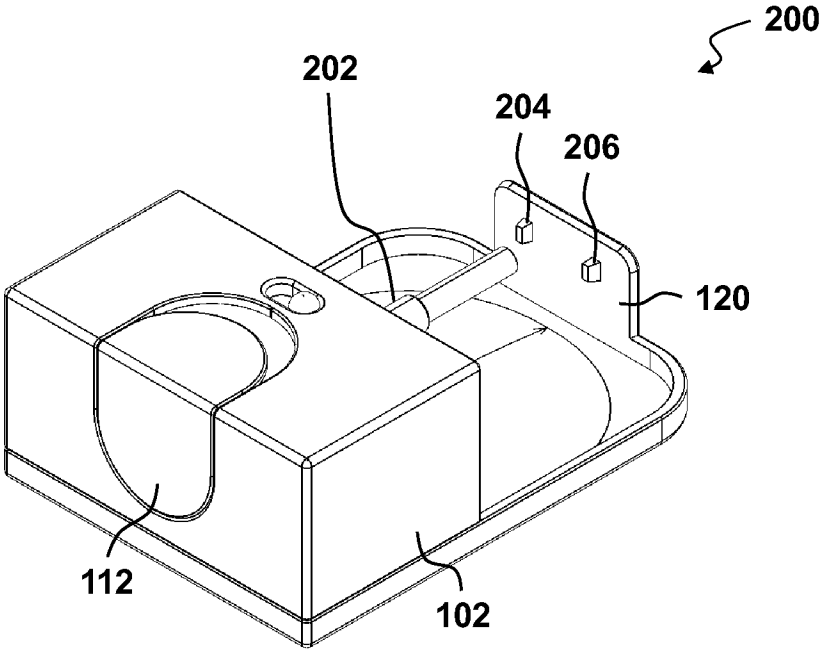
FIG. 2A depicts a perspective view of a foundation pump embodiment with a bottle removed.

FIG. 2A depicts a perspective view of a foundation pump 200 embodiment with a bottle removed. FIG. 2B depicts a reverse perspective view of the foundation pump embodiment of FIG. 2A with the bottle removed. A pump actuator 202 may be partially disposed in the top cap 102. A depression of the press button 112 may actuate the pump actuator 202. The bottle may be detachably attached to an opening 208 of the pump actuator, such as a threaded opening. The top cap 102 may include a void 210 about the pump actuator 208. In some embodiments, at least a portion of the bottle may extend into the void 210. The platform 120 may include at least one protrusion (204, 206) to fit into the at least one indentation on a bottom surface of the bottle.

Figure 3:
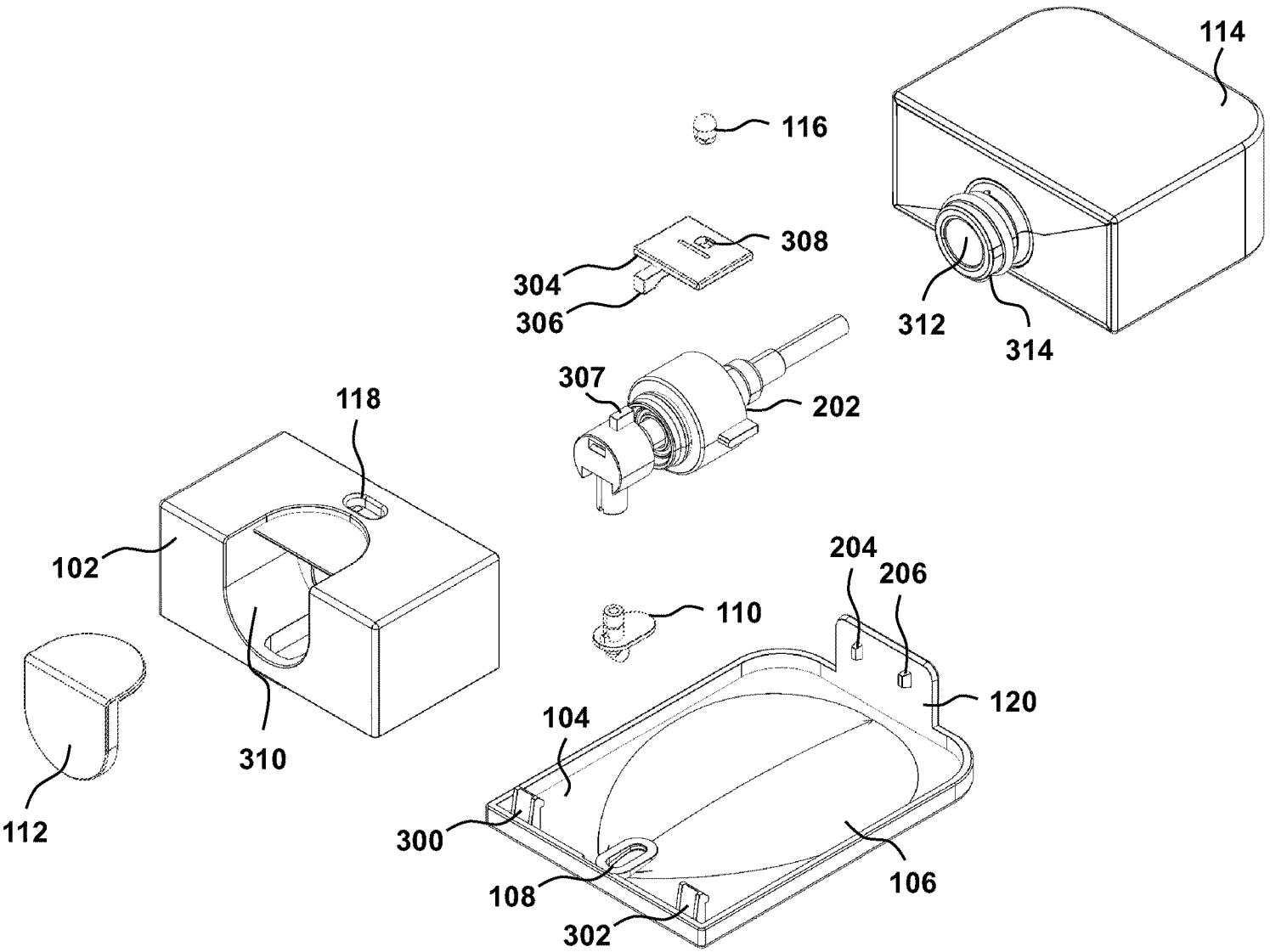
FIG. 3 depicts an exploded perspective view of the foundation pump embodiment of FIG. 1A.

FIG. 3 depicts an exploded perspective view of the foundation pump embodiment of FIG. 1A. The front plate 104 may include one or more clips (300, 302) for detachably attaching the front plate 104 to the top cap 102. The one or more clips (300, 302) may provide a snap-fit assembly via interlocking components. In other embodiments, the front plate 104 may be attached to the top cap 102 via an adhesive, friction fit, or the like.

The back button 116 may be attached to a back button plate 304 via an aperture 308. The back button plate 304 may have at least one protrusion 306. The back button 116 may be disposed through and slidable in the button opening 118 between a locked position and an unlocked position. The at least one protrusion 306 of the back button plate 304 may prevent the depression of the press button 112 in the locked position when aligned with a protrusion 307 of the pump actuator 202 or control the level of depression of the press button 112 if providing control over the disposal amount. When the back button 116 is slid to the unlocked position, the protrusion 306 of the back button plate 304 and the protrusion 307 of the pump actuator 202 are not aligned and the press button 112 may be depressed, allowing liquid from the bottle 114 to flow through the pump actuator 202 and front nozzle 110 onto the indentation 106 of the front plate 104. The top cap 102 may comprise a void 310 to allow the press button 112 to press down into the top cap 102 and against a pump of the pump actuator 202.

In one embodiment, the container or bottle 114 may include an opening 312 to receive the pump actuator 202. The bottle 114 may include a detachable attachment 314, such as a threaded lip to be received by the threaded opening of the pump actuator 202. In some embodiments, the bottle 114 may include two or more openings and may receive one or more pump actuators for dispensing liquid in those two or more openings. The bottle 114 may have one or more curved edges that correspond to one or more curved edges on the front plate 104. In some embodiments, the bottle 114 may be detachable from the pump actuator 202, such that the bottle 114 may be replaced with a new bottle. In other embodiments, an adhesive may fix the bottle 114 to the pump actuator and/or front plate 104, such that it cannot be removed by a user, for example, a onetime use.

Figure 4:
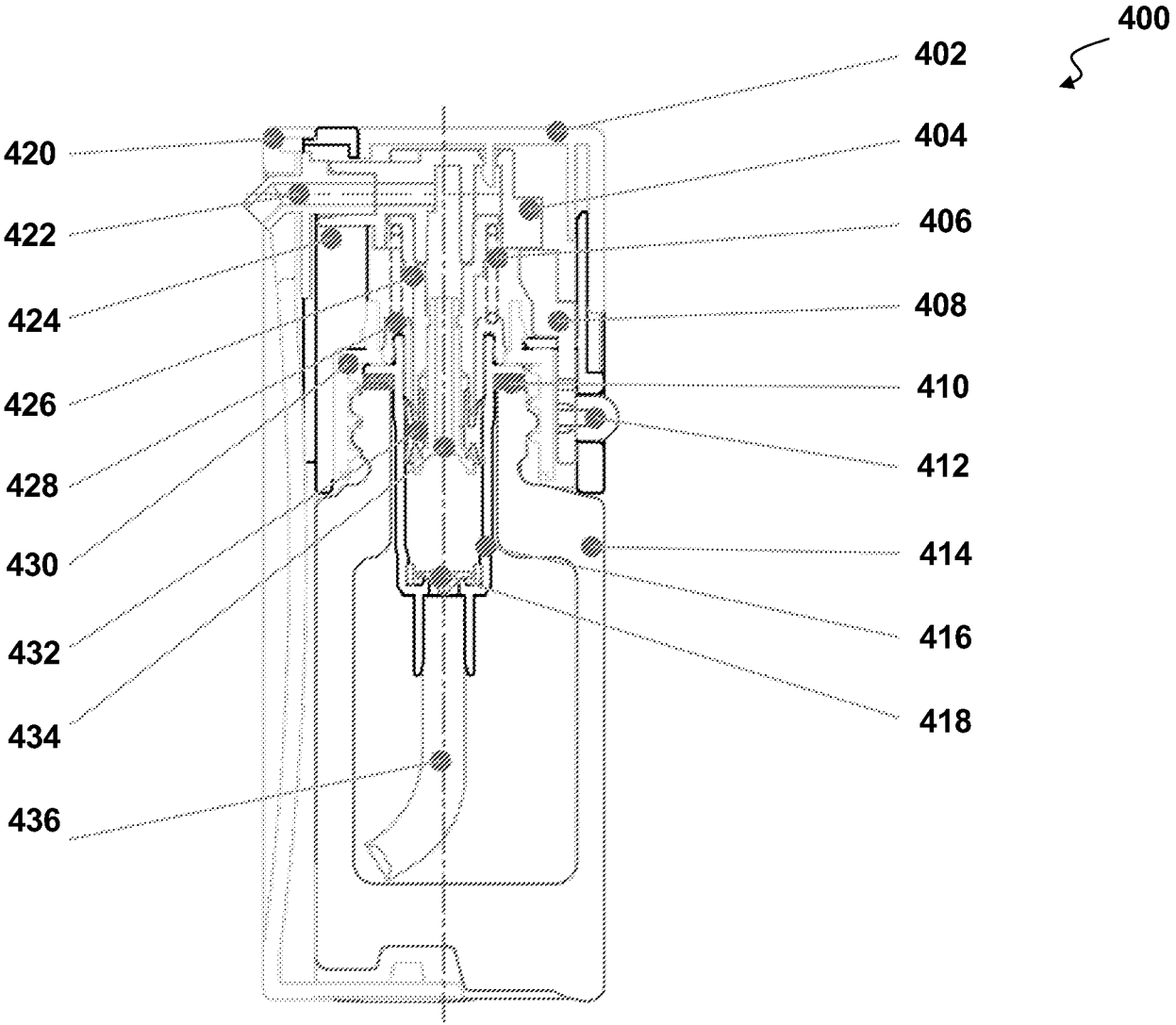
FIG. 4 depicts a cross-sectional view of the foundation pump embodiment along line 4-4 of FIG. 1E.

FIG. 4 depicts a cross-sectional view of the foundation pump 400 embodiment along line 4-4 of FIG. 1E. The pump 400 may include an actuator cover 402, an actuator 404, a spring 406, a stopper 408, a gasket 410, a lock button 412, a bottle 414, a housing 416, a disk-valve 418, a case 420, an actuator tip 422, a case 424, a stem 426, a chaplet 428, a container cap 430, a piston 432, a piston base 434, and a tube 436. The actuator cover 402 and case 424 may be made from a plastic, such as acrylonitrile butadiene styrene (ABS). The actuator 404, lock button 412, housing 416, actuator tip 422, and container cap 430 may be made from a plastic, such as polypropylene (PP). The spring 406 may be made from a metal, such as stainless steel. The stopper 408 may be made from a plastic, such as polyketones. The gasket 410 and tube 436 may be made from a plastic, such as polyethylene. The bottle 414 may be made from glass. The disk- valve 418 may be made from a plastic, such as low-density polyethylene (LDPE). Case 420 may be made from a plastic, such as polyethylene terephthalate glycol (PETG). The stem 426, chaplet 428, and piston base 434 may be made from a plastic, such as polyoxymethylene (POM). The piston 432 may be made from a plastic, such as linear low-density polyethylene (LLDPE). The spring 406 may be a resilient element designed to return the press button (112, FIG. 3) to an original position following a depression of the press button to dispense the contents of the container (114, FIG. 3).

Figure 5:
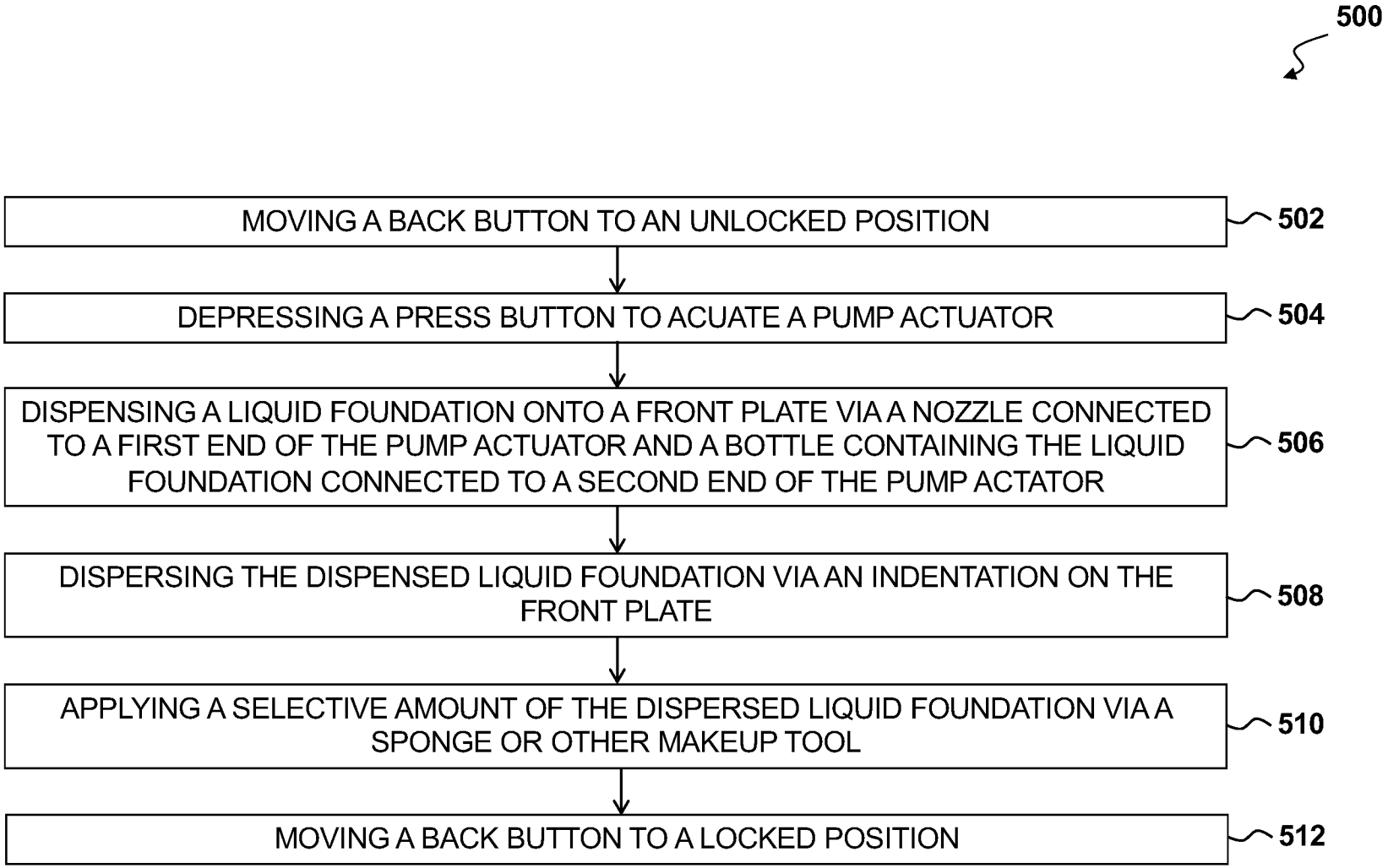
FIG. 5 depicts a block diagram of a method of dispensing foundation via a foundation pump.

FIG. 5 depicts a block diagram of a method 500 of dispensing foundation via an embodiment of the foundation pump apparatus. The back button may be moved to an unlocked position (step 502). The press button may be depressed to actuate a pump actuator (step 504). The liquid foundation may be dispensed onto a front plate via a nozzle connected to a first end of the pump actuator and a bottle containing the liquid foundation connected to a second end of the pump actuator (step 506). In some embodiments, other liquids and/or makeups may be dispensed by the device that are stored in the bottle. The dispensed liquid may be dispersed via an indentation on the front plate (step 508). A selective amount of the dispersed liquid foundation may be selectively applied via a sponge or other makeup tool (step 510). The back button may be moved back to a locked position (step 512). The locked position may prevent depression of the press button and prevent inadvertent dispensing of the liquid foundation.

Figure 6:
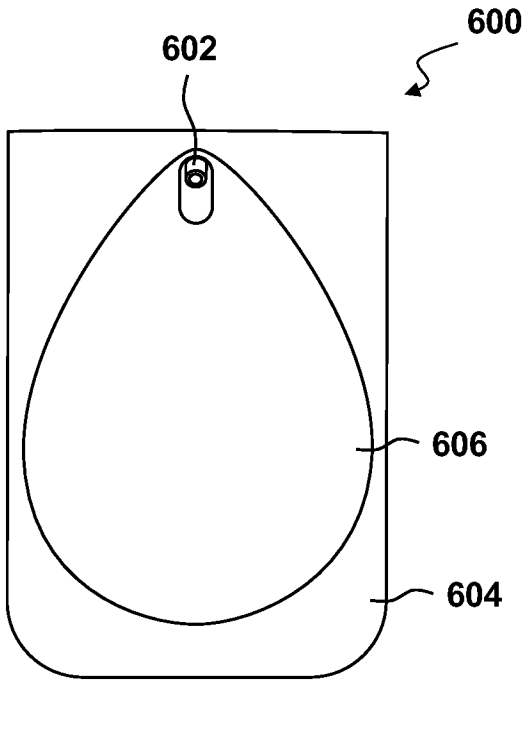
FIG. 6 depicts a front view of an alternate embodiment of the foundation pump for dispensing two liquids via a single nozzle.

FIG. 6 depicts a front view of an alternate embodiment of the foundation pump 600 for dispensing two liquids via a single nozzle. The nozzle 602 may dispense two liquids onto an indentation 606 on the front plate 604. The two liquids may include at least two of: a first color foundation, a second color foundation, a concealer, a primer, and a highlighter. The indentation 606 may allow a user to combine colors of foundation, mix in a modifiable primer, and/or mix in a highlighter, oil or texturizer. In some embodiments, the user may pump the foundation into the indentation 606, add the additional formula, and use the indentation 606 to mix it together.

Figure 7:
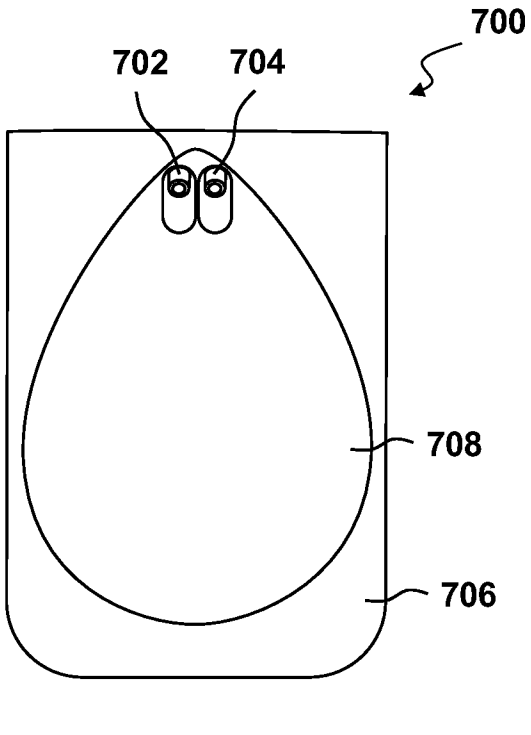
FIG. 7 depicts a front view of another alternate embodiment of the foundation pump for dispensing two liquids through two separate nozzles.

FIG. 7 depicts a front view of yet another alternate embodiment of the foundation pump 700 for dispensing two liquids through two separate nozzles. The nozzles (702, 704) may each dispense a different liquid makeup, such as a first color foundation, a second color foundation, a concealer, a primer, and a highlighter. The nozzles (702, 704) may be located proximate to one another and both aligned to dispense the liquid onto the indentation 708 on the front plate 706. In one embodiment, the nozzles (702, 704) may be pointed toward each other so that the liquids being dispensed are mixed with each other as they exit the nozzle. In another embodiment, the liquids may be pre-mixed before being dispersed out of the nozzles, inside the foundation pump 700.

Figure 8:
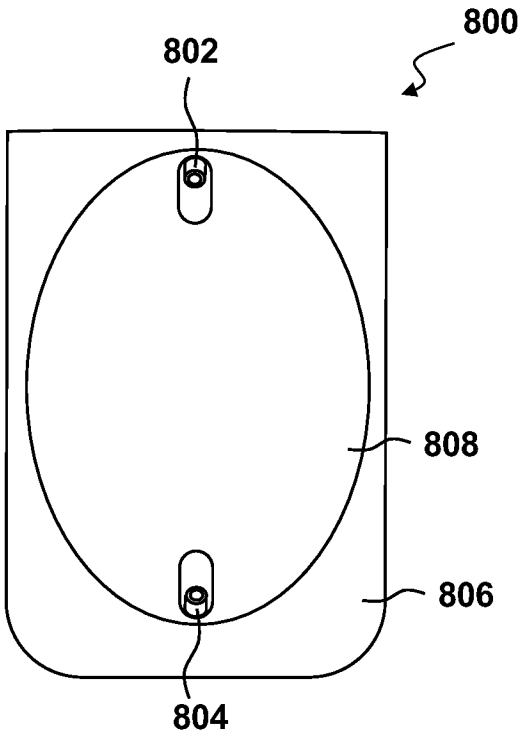
FIG. 8 depicts a front view of another alternate embodiment of the foundation pump having two nozzles and an alternate indentation shape on a front plate.

FIG. 8 depicts a front view of another alternate embodiment of the foundation pump 800 having two nozzles and an alternate indentation shape on a front plate. The nozzles (802, 804) may each dispense a different liquid makeup, such as a first color foundation, a second color foundation, a concealer, a primer, and a highlighter. The nozzles (802, 804) may be located distal from one another to provide greater control of mixing. The indentation 808 on the front plate 808 may be an oval, teardrop, circle, or any other shape to allow for mixing and/or application of makeup within. Once finished, a user may wipe off the front plate 806, such as with a makeup wipe, tissue, paper towel, a carry case, and/or any other suitable accessory to remove any residue from the prior use.

Figures 9, 10, 11:
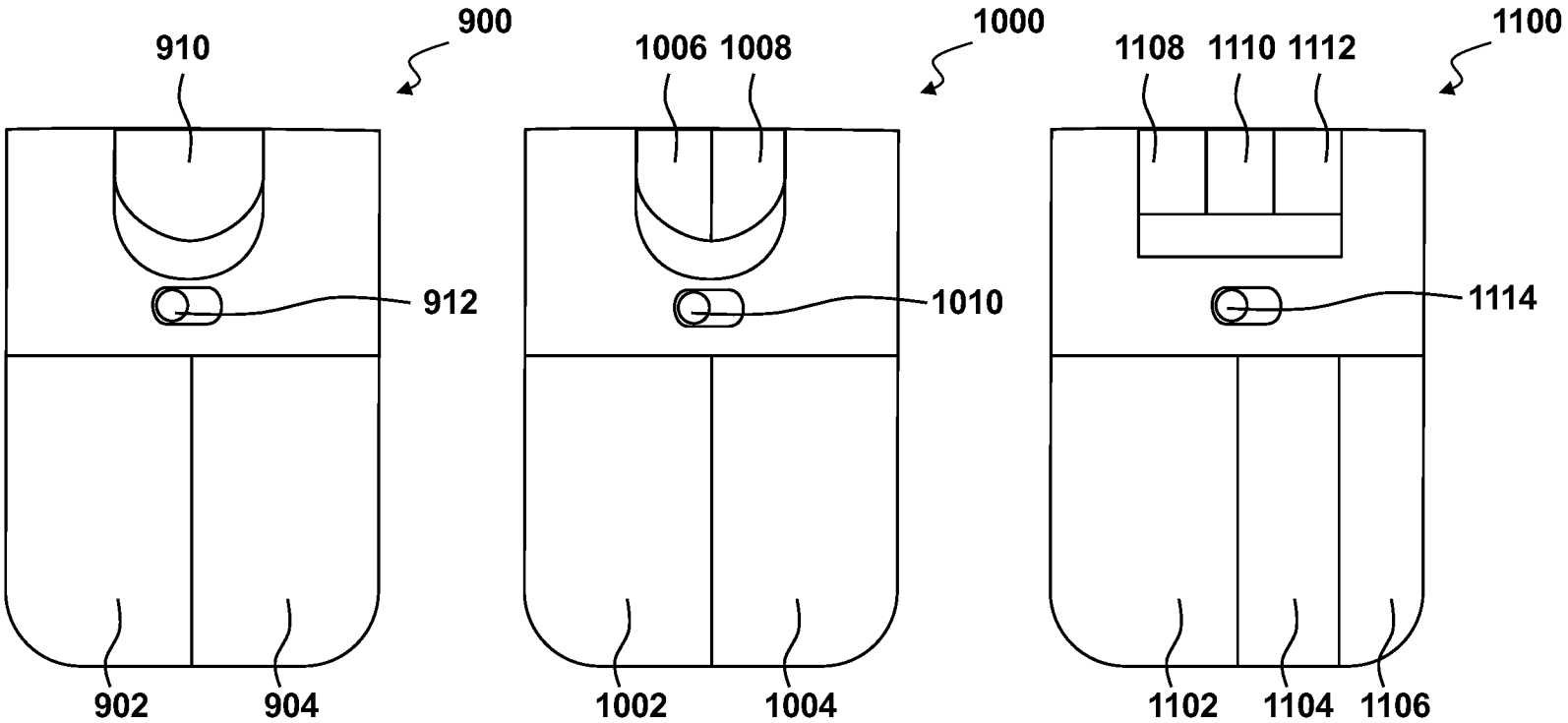
FIG. 9 depicts a rear view of an alternate embodiment of the foundation pump having two liquids in a bottle and a single press button.
FIG. 10 depicts a front view of another alternate embodiment of the foundation pump having two liquids in a bottle and two press buttons.
FIG. 11 depicts a front view of another alternate embodiment of the foundation pump having three liquids in a bottle and three press buttons.

FIG. 9 depicts a rear view of an alternate embodiment of the foundation pump 900 having two containers (902, 904) in a bottle and a single press button (910). The selected container (902, 904) may be selected via a slider 912. The liquid may be selected based on the slider 912 selection determining which container liquid would be pumped from. Each container (902, 904) may contain a different type of liquid and/or foundation.

FIG. 10 depicts a front view of another alternate embodiment of the foundation pump 1000 having two containers (1002, 1004) in a bottle and two press buttons (1006, 1008). The first push button 1006 may dispense liquid from the first container 1002. The second push button 1008 may dispense liquid from the second container 1004. In one embodiment, the slider 1010 may be used to select between a locked position where neither button (1006, 1008) can be pressed, a first unlocked position where the first button 1006 can be pressed, and a second unlocked position where the second button 1008 can be pressed. In some embodiments, the slider 1010 may be used to select between a locked position where neither button (1006, 1008) can be pressed and an unlocked position where both buttons (1006, 1008) can be pressed. Each container (1002, 1004) may contain a different liquid. In this embodiment, the liquids may be pre-mixed before dispensing onto the indentation.

FIG. 11 depicts a front view of another alternate embodiment of the foundation pump having three containers (1102, 1104, 1106) in a bottle and three press buttons (1108, 1110, 1112). The first push button 1108 may dispense a first liquid from the first container 1102. The second push button 1110 may dispense a second liquid from the second container 1104. The third push button 1112 may dispense a third liquid from the third container 1106. The slider 1114 may be used to select between a locked position where none of the buttons (1108, 1110, 1112) can be pressed and an unlocked position where all of the buttons (1108, 1110, 1112) can be pressed. In embodiments where the bottle contains more than one liquid, the portions of the bottle may not be evenly divided, such as where more liquid foundation is needed than liquid concealer.

Figure 12B:
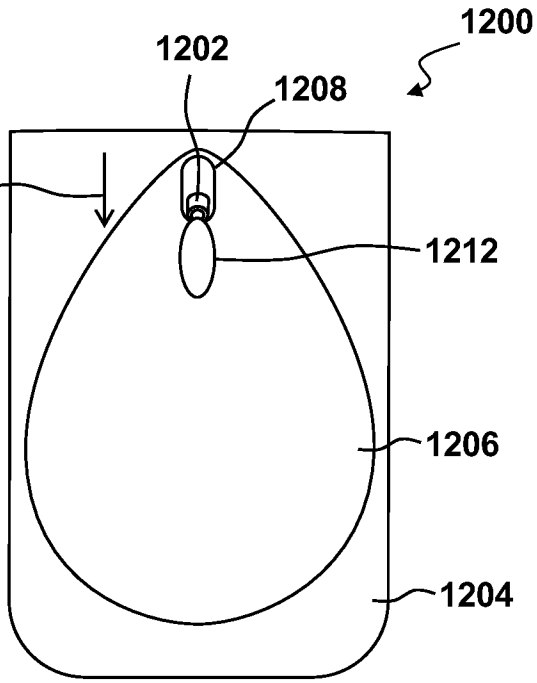
FIG. 12B depicts a top view of the alternate embodiment of the foundation pump of FIG. 12A with the nozzle moving while dispensing.
Figure 12A:
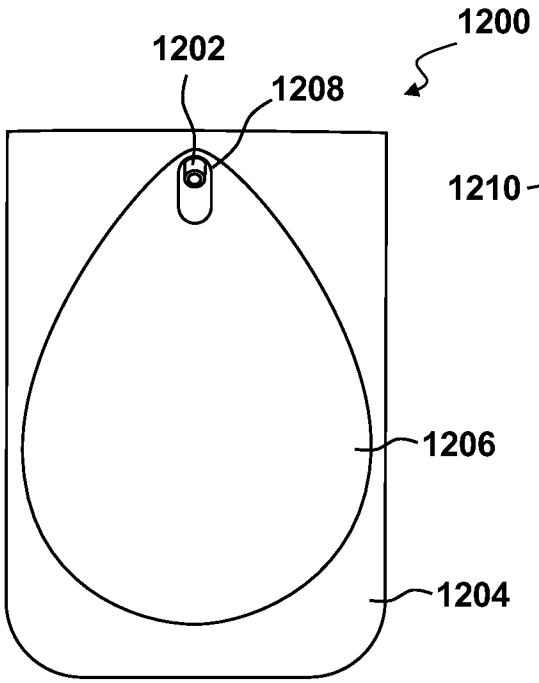
FIG. 12A depicts a top view of an alternate embodiment of a foundation pump prior to dispensing.

FIG. 12A depicts a top view of an alternate embodiment of a foundation pump 1200 prior to dispensing. The nozzle 1202 may be disposed at a top portion of the nozzle opening 1208. The top portion of the nozzle opening 1208 may be proximate a tip of the indentation 1206 on the front plate 1204. The nozzle opening 1208 may be an elongated channel in some embodiments.

FIG. 12B depicts a top view of the alternate embodiment of the foundation pump 1200 of FIG. 12A with the nozzle 1202 moving 1210 while dispensing. The nozzle 1202 may dispense a liquid 1212 onto the indentation 1206 on the front plate 1204. The liquid 1212 may be a liquid foundation or other cosmetic/makeup. The nozzle 1202 may move toward a bottom portion of the nozzle opening 1208. The bottom portion of the nozzle opening 1208 may be distal from the top portion of the nozzle opening, as shown in FIG. 12A. The nozzle 1202 may move 1210 in the nozzle opening 1208 as the press button is depressed to dispense the liquid 1212. In some embodiments, the nozzle 1202 may be directly connected to the pump actuator such that the nozzle 1212 moves along with a movement of the press button and/or pump actuator. In some embodiments, the liquid 1212 may not dispense until the nozzle 1202 has reached the bottom portion of the nozzle opening 1208. In other embodiments, the liquid 1212 may dispense throughout movement of the nozzle 1202 in the nozzle opening 1208. Once the liquid 1212 is dispensed, the nozzle may return to its original position at the top portion of the nozzle opening 1208 such as shown in FIG. 12A.

Figure 13:
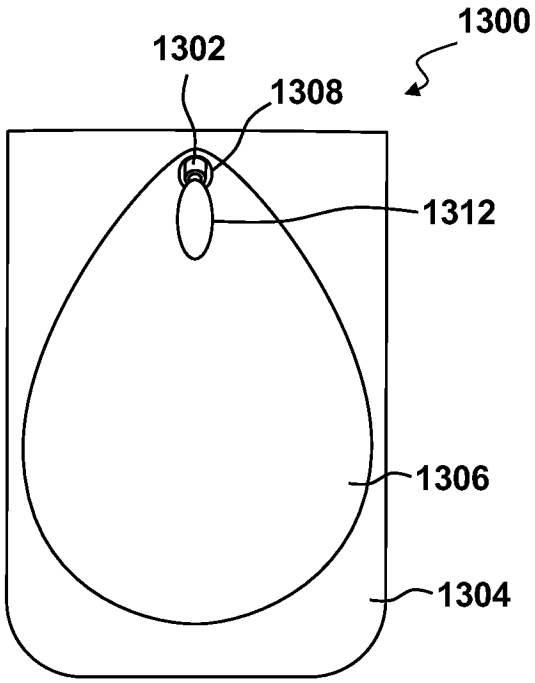
FIG. 13 depicts a top view of an alternate embodiment of a foundation pump with the nozzle stationary while dispensing.

FIG. 13 depicts a top view of an alternate embodiment of a foundation pump 1300 with the nozzle 1302 stationary while dispensing. The nozzle 1302 may dispense a liquid 1312 onto the indentation 1306 on the front plate 1304. In some embodiments, the nozzle 1302 may remain stationary or substantially stationary while dispensing the liquid 1312. By way of example, and not limitation, the nozzle 1302 may be connected to the press button and/or pump actuator via a flexible tubing such that the nozzle 1302 remains stationary during movement of the press button and/or pump actuator. In some embodiments, the nozzle opening 1308 may be a circle, oval, square, or other shape that corresponds to the shape of the nozzle 1302. In other embodiments, the nozzle opening may be a channel, such as shown in FIGS. 12A-12B. In other embodiments, the nozzle 1302 may be retracted when locked and/or not in use. By way of example, and not limitation, the nozzle 1302 may be stationary when liquid 1312 is being dispensed, but may retract and/or reveal to dispense liquid 1312, such as by moving in an elongated channel 1208, such as shown in FIGS. 12A-12B.

Figures 14A, 14B, 14C:
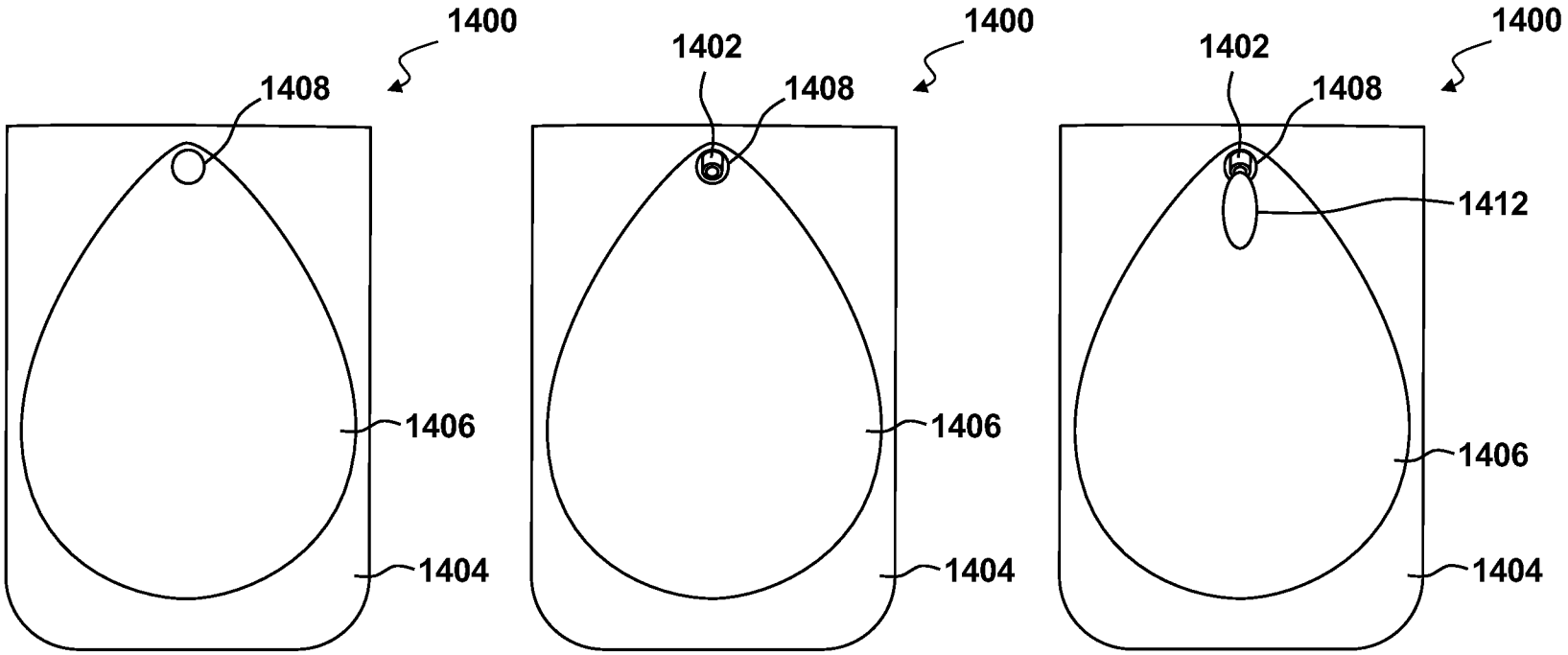
FIG. 14A depicts a top view of an alternate embodiment of a foundation pump having a hidden nozzle.
FIG. 14B depicts a top view of the alternate embodiment of the foundation pump of FIG. 14B having the nozzle revealed.
FIG. 14C depicts a top view of the alternate embodiment of the foundation pump of FIG. 14B having the nozzle revealed while dispensing.

FIG. 14A depicts a top view of an alternate embodiment of a foundation pump 1400 having a hidden nozzle 1402. FIG. 14B depicts a top view of the alternate embodiment of the foundation pump 1400 of FIG. 14B having the nozzle 1402 revealed. FIG. 14C depicts a top view of the alternate embodiment of the foundation pump 1400 of FIG. 14B having the nozzle 1402 revealed while dispensing a liquid 1412. In some embodiments, the nozzle 1402 may be hidden when not in use. In other embodiments, the nozzle 1402 may be hidden when not dispensing. In other embodiments, the nozzle 1402 may be hidden when locked. The nozzle 1402 may rotate, actuate, slide, or otherwise be hidden beneath the front plate 1404 of the foundation pump 1400. The nozzle 1402 may appear in the nozzle opening 1408 to dispense a liquid 1412 onto the indentation 1406 of the front plate 1400. After dispensing, use, and/or when locked the nozzle 1402 may remain hidden, such as shown in FIG. 14A. Hiding the nozzle 1402 may allow a user to know the state of the foundation pump, such as whether the foundation pump is locked or unlocked. Hiding the nozzle 1402 may also prevent the liquid 1412, such as a liquid foundation, from being transferred to other objects. By way of example, and not limitation, a user may place the foundation pump 1400 in their purse and the hidden nozzle 1402 may prevent transfer of liquid foundation from a tip of the nozzle 1402 to other objects in their purse and/or the purse itself.

Figure 15:
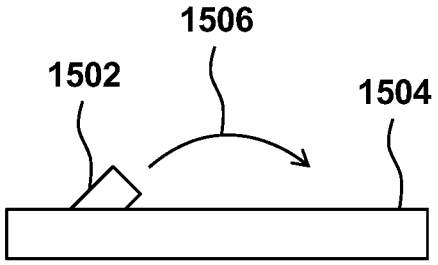
FIG. 15 depicts a side view of a nozzle angled relative to a front plate of a foundation pump.

FIG. 15 depicts a side view of a nozzle 1502 angled relative to a front plate 1504 of a foundation pump. The nozzle 1502 may dispense liquid in a direction 1506 that may place the liquid on the front plate 1504 at a location further from the nozzle 1502. This location may allow for easier mixing of the liquid on the front plate 1504.

Figure 16:
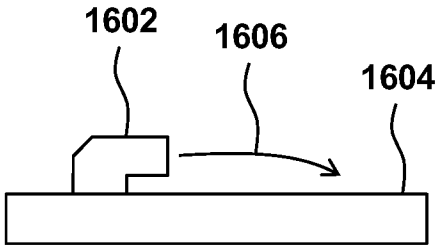
FIG. 16 depicts a side view of an alternate nozzle angled relative to a front plate of a foundation pump.

FIG. 16 depicts a side view of an alternate nozzle 1602 angled relative to a front plate 1604 of a foundation pump. The nozzle 1602 may dispense liquid in a direction 1606 that may place the liquid on the front plate 1604 at a location closer to the nozzle 1602 than in the nozzle shown in FIG. 15.

Figure 17:
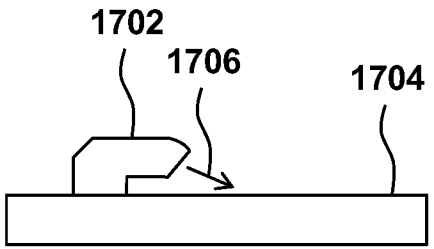
FIG. 17 depicts a side view of another alternate nozzle angled relative to a front plate of a foundation pump.

FIG. 17 depicts a side view of another alternate nozzle 1702 angled relative to a front plate 1704 of a foundation pump. The nozzle 1702 may dispense liquid in a direction 1706 that may place the liquid on the front plate 1704 at a location closer to the nozzle 1702 than in the nozzles shown in FIGS. 15-16. The angle and/or dimensions of the nozzle 1702 may be angled based on a desired dispensing location of the liquid on the front plate 1704. The angle and/or dimensions of the nozzle 1702 may also be adjusted based on the liquid being dispensed on the front plate 1704. By way of example, and not limitation, a viscosity of the liquid being dispensed may cause the liquid to overshoot the front plate 1504 in some embodiments. As another example, a tendency for certain liquids to clog the nozzle 1502 may cause a build-up of pressure that may cause the liquid to overshoot the front plate in some embodiments. By adjusting the angle and/or dimensions of the nozzle, the likelihood of having a liquid overshoot the front plate 1704 may be eliminated, minimized, and/or reduced.

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further, it is intended that the scope of the present invention herein disclosed by way of examples should not be limited by the particular disclosed embodiments described above.

What is claimed is:

1. A method comprising:

setting a back button of a foundation pump to an unlocked position, wherein the unlocked position allows for a depression of a press button, wherein the back button is attached to a back button plate, and wherein the back button plate comprises at least one protrusion;

depressing the press button to actuate a pump actuator, wherein the pump actuator comprises at least one protrusion;

dispensing a liquid onto a front plate via a nozzle, wherein the nozzle is connected to a first end of the pump actuator, and wherein a container containing the liquid is connected to a second end of the pump actuator;

dispersing the dispensed liquid via an indentation on the front plate; and setting the back button of the foundation pump to a locked position, wherein the locked position prevents depression of the press button by contacting the at least one protrusion of the back button plate with the at least one protrusion of the pump actuator to prevent the depression of the press button.

2. The method of claim 1 further comprising:

rotating the foundation pump from a first position to a second position after depressing of the press button to actuate the pump actuator, while maintaining the liquid on the indentation.

3. The method of claim 2 further comprising:

applying a selective amount of the dispersed liquid on the indentation on the front plate via a makeup tool.

4. The method of claim 1, wherein the back button is attached to a back button plate and disposed through a button opening disposed in a top cap.

5. The method of claim 4, wherein setting the back button between the locked position and the unlocked position comprises sliding the back button in the button opening.

6. The method of claim 1, wherein the indentation provides varying amounts of liquid across a surface area of the indentation.

7. The method of claim 6, further comprising:

picking up the varying amounts of liquid from the indentation via a makeup tool.

8. The method of claim 1, further comprising:

attaching the container to the pump actuator.

9. The method of claim 8, wherein the container is detachably attached to the pump actuator.

10. The method of claim 1, wherein the nozzle is angled to dispense the liquid onto the front plate.

11. The method of claim 1, wherein the dispensed liquid comprises a liquid foundation.

12. The method of claim 1, wherein the dispensed liquid comprises two or more of: a liquid makeup, a first color foundation, a second color foundation, a concealer, a primer, and a highlighter.

13. The method of claim 1, wherein the press button comprises two or more press buttons, wherein the container comprises two or more containers, and wherein the nozzle comprises two or more nozzles.

14. The method of claim 1, wherein the nozzle remains stationary as liquid is dispensed through the nozzle.

15. A method comprising:

setting a back button of a foundation pump to an unlocked position, wherein the unlocked position allows for a depression of a press button;

depressing the press button to actuate a pump;

dispensing a liquid onto a front plate via a nozzle, wherein the nozzle is connected to a first end of the pump actuator, and wherein a container containing the liquid is connected to a second end of the pump actuator, wherein dispensing the liquid onto the front plate via the nozzle further comprises:

moving the nozzle toward a bottom portion of a nozzle opening during depression of the press button, wherein the nozzle is disposed through the nozzle opening; and moving the nozzle toward a top portion of the nozzle opening once the liquid is dispersed through the nozzle opening; and dispersing the dispensed liquid via an indentation on the front plate,.

16. A method comprising:

setting a back button of a foundation pump to an unlocked position, wherein the unlocked position allows for a depression of a press button;

depressing the press button to actuate a pump;

dispensing a liquid onto a front plate via a nozzle, wherein the nozzle is connected to a first end of the pump actuator, and wherein a container containing the liquid is connected to a second end of the pump actuator;

dispersing the dispensed liquid via an indentation on the front plate; and retracting the nozzle behind the-a front plate after dispensing the liquid onto the front plate.

* * * * *